US008836488B2

(12) United States Patent
You

(10) Patent No.: US 8,836,488 B2
(45) Date of Patent: Sep. 16, 2014

(54) METHOD OF TURNING AN ALARM OFF AND MOBILE DEVICE ADAPTED THERETO

(75) Inventor: Yong Ho You, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 299 days.

(21) Appl. No.: 13/288,496

(22) Filed: Nov. 3, 2011

(65) Prior Publication Data

US 2012/0176230 A1 Jul. 12, 2012

(30) Foreign Application Priority Data

Jan. 10, 2011 (KR) ..... 10-2011-0002178

(51) Int. Cl.

| | |
|---|---|
| ***G08B 1/00*** | (2006.01) |
| ***G08B 21/00*** | (2006.01) |
| ***G04B 23/02*** | (2006.01) |
| ***G04G 13/02*** | (2006.01) |

(52) U.S. Cl.

CPC ..... *G04G 13/02* (2013.01)

USPC ..... 340/309.7; 340/309.16; 340/540; 368/244; 368/267

(58) Field of Classification Search

None

See application file for complete search history.

(56) References Cited

U.S. PATENT DOCUMENTS 6,809,641 B2 * 10/2004 Choi et al. ..... 340/501

* cited by examiner

*Primary Examiner* — Julie Lieu

(74) *Attorney, Agent, or Firm* — Jefferson IP Law, LLP

(57) ABSTRACT

An alarm turning off method and a mobile device adapted to the method are provided. The method includes reproducing a preset alarm audio sound and outputting a preset beat at a preset alarm time, determining whether the mobile device receives an input beat, when the mobile device has received the input beat, muting the reproduced alarm audio sound, determining whether the preset beat is identical to the input beat in a state where the alarm audio sound is muted, and turning off the alarm when the number of occurrences where the preset beat matches the input beat is a preset number in a state where the alarm audio sound is muted.

17 Claims, 3 Drawing Sheets

METHOD OF TURNING AN ALARM OFF AND MOBILE DEVICE ADAPTED THERETO

PRIORITY

This application claims the benefit under 35 U.S.C. §119 (a) of a Korean patent application filed on Jan. 10, 2011 in the Korean Intellectual Property Office and assigned Serial No. 10-2011-0002178, the entire disclosure of which is hereby incorporated by reference.

BACKGROUND OF THE INVENTION

1. Field of the Invention

The present invention relates to alarm systems for mobile devices. More particularly, the present invention relates to a method for turning off an alarm using a beat of alarm audio sound and to a mobile device adapted to the method.

2. Description of the Related Art

Mobile devices provide an alarm service for schedules. An alarm service determines whether a preset time arrives and notifies the mobile device users of their schedules, such as waking up, exercising, a meeting, club attendance, and the like. An alarm service may notify the users of their schedules, via an audible audio sound, a visual means, a vibration means, and the like. There are various types of methods for turning off an alarm, for example, a user's simple input, such as operating a keypad, recognizing whether a mobile device is moved, detecting whether the folder of the mobile device is opened and then closed, and the like. When a user accidentally turns off an alarm in the mobile device, so the mobile device does not properly perform the notification of a user's schedule, for example, a wake-up call, the user may be inconvenienced.

In addition, the alarm service according to the related art keeps ringing in the mobile device until the user turns off the alarm function via the schedule notifying means described above. In this case, such ringing inconveniences other people near the mobile device user.

SUMMARY OF THE INVENTION

Aspects of the present invention are to address the above mentioned problems and/or disadvantages and to provide at least the advantages described below. Accordingly, an aspect of the present invention is to provide a method that turns off an alarm when a user inputs, to a mobile device, a beat that matches a beat set in a state where an alarm audio sound is muted, via a preset mode and a mobile device adapted to the method.

In accordance with an aspect of the present invention, a method for turning off an alarm in a mobile device is provided. The method includes reproducing a preset alarm audio sound and outputting a preset beat at a preset alarm time, determining whether the mobile device receives an input beat, muting, when the mobile device has received a input beat, the reproduced alarm audio sound, determining whether the preset beat is identical to the input beat in a state where the alarm audio sound is muted, and turning off the alarm when the number of occurrences where the preset beat matches the input beat is a preset number in a state where the alarm audio sound is muted.

In accordance with another aspect of the present invention, a mobile device is provided. The device includes an audio processing unit for reproducing a preset alarm audio sound, a display unit for displaying a preset beat, a storage unit for storing the preset alarm audio sound and the preset beat, and a controller for controlling to reproduce the preset alarm audio sound at a preset alarm time, for muting, when the mobile device has received an input beat, the reproduced alarm audio sound, and for stopping an output of the preset beat when the number of occurrences where the preset beat matches the input beat is a preset number.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the invention will become more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

Figure 1:
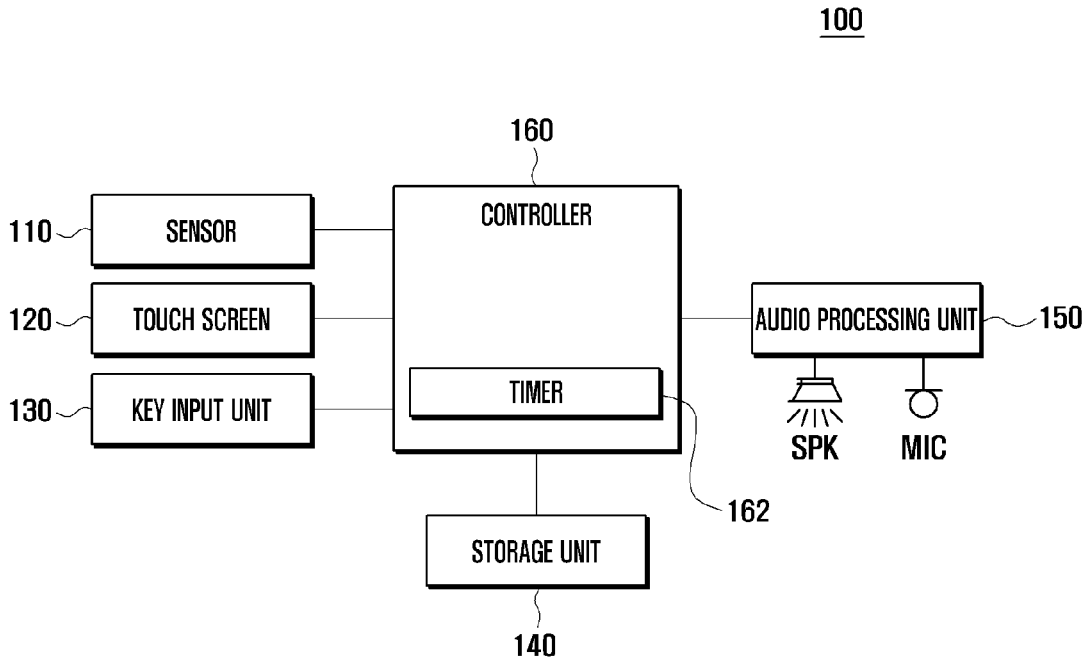
FIG. 1 illustrates a schematic block diagram of a mobile device according to an exemplary embodiment of the present invention.

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In the following description, the term 'beat' denotes a particular pattern according to time, such as a tempo of an audio sound, a rhythm of an audio sound, a period of time, and the like. The term 'alarm setting mode' denotes a mode to set information for executing an alarm and turning off the alarm. The term 'alarm execution mode' denotes a mode where an alarm audio sound is played back or muted, a preset beat is output, a user's input is received, and the alarm is turned off according to the user's input, from an alarm time to an alarm turn off time.

Exemplary embodiments of the present invention provide a method for turning off an alarm service for a schedule, and also a mobile device adapted to the method. When the mobile device is in an alarm execution mode, it can mute an alarm audio sound according to a user's input beat. When the user inputs a beat in a preset mode to the mobile device in a state where an alarm audio sound is muted, the mobile device turns off the alarm. On the contrary, when the user does not input a beat in a preset mode to the mobile device in a state where an alarm audio sound is muted, the mobile device replays back the alarm audio sound.

Therefore, the user needs to consciously input a beat in a preset mode to the mobile device in order to turn off the alarm. In an exemplary embodiment of the invention, a beat in a preset mode is composed of a series of input movements of a user. That is, the mobile device requires a user's conscious and continuous movements in order to turn off the alarm. The alarm turning off method can alert a mobile device user without playing back an audio sound in the mobile device, thereby minimizing disturbance to other people near the user. In the following description, the method for turning off the alarm and the mobile device adapted to the method are described in more detail below.

FIG. 1 illustrates a schematic block diagram of a mobile device according to an exemplary embodiment of the present invention.

Referring to FIG. 1, the mobile device 100 includes a sensor 110, a touch screen 120, a key input unit 130, a storage unit 140, an audio processing unit 150 and a controller 160.

The mobile device 100 can be applied to all information communication devices, multimedia devices, and their applications, such as, mobile communication devices, wired/wireless phones, Personal Digital Assistants (PDAs), smartphones, Digital Multimedia Broadcasting (DMB) terminals, table Personal Computers (PCs), Global System for Mobile communication (GSM) terminals, General Packet Radio System (GPRS), 3G terminals (e.g., International Mobile Telecommunication 2000 (IMT-2000) terminals that employ Wideband Code Division Multiple Access (WCDMA) technology), Universal Mobile Telecommunication Service (UMTS) terminals, and the like. The mobile device 100 provides an alarm service.

The sensor 110 detects the motion of the mobile device 100. The sensor 110 is implemented with at least one of a gyro sensor, an acceleration sensor, and the like. It should be understood that the sensor 110 may also be implemented with any other detecting components that can detect the motion of the mobile device 100. The acceleration sensor can detect acceleration in the x-axis, y-axis and z-axis. The gyro sensor can detect movement, using angular momentum, with respect to an inertial space around one or more axes that are orthogonal to a spin axis. The sensor 110 detects the motion of the mobile device 100 with respect to the x-axis, y-axis and z-axis, and creates corresponding signals. The sensor 110 detects a tilt and the motion of the mobile device 100 and outputs the detected motion information. The sensor 110 is turned on when the controller 160 executes the alarm and is turned off when the controller 160 turns off the alarm.

The touch screen 120 includes a display unit and a touch panel, which are not illustrated. The display unit displays the states of the mobile device 100. The display unit also displays operation states and screen data of the mobile device 100, a user's input information, and the like. The touch panel is installed to one side of the display unit. The touch panel detects a touch event and outputs a coordinate value of the touch event. The touch panel may be implemented with various types of detecting modes to detect a touch event that occurred thereon, for example, a pressure sensor type, a capacitive overlay type, an infrared beam type, and the like. The touch panel detects the touch event and creates a touch detected signal including the touched coordinates.

The storage unit 140 includes a program storage memory and a data storage memory. The program storage memory stores a program related to the operations of the mobile device 100. The program storage memory also stores a program for executing and turning off the alarm. The data storage memory stores data that is used or created when the programs are executed.

The storage unit 140 stores alarm execution and termination information set by the user. Examples of the alarm execution and termination information are an alarm time, an alarm execution time, a list of alarm audio sound candidates, a set alarm audio sound, a preset beat, a mode for outputting the preset beat, a mode for receiving a user's input beat, a beat matching frequency for counting how many times compared beats match with each other in order to turn off the alarm, a beat matching count for counting the frequency of matching beats compared with each other, and the like. A set alarm time may be periodically repeated. For example, an alarm time can be set to 6:00 a.m. An alarm time can also be set in such a mode that the alarm executes itself every morning at 6:00 a.m. from Monday through Friday. The alarm execution time refers to a period of time required to execute an alarm execution mode. In an exemplary implementation, the alarm execution time may replace a repetition frequency of an audio sound. An audio sound may be repeatedly played back during the alarm execution time. The mode for outputting the preset beat may be an image display mode and a vibration outputting mode. The image outputting mode displays an image for the preset beat on the display unit of the touch screen 120. The vibration outputting mode outputs vibration for the preset beat, at a certain period, via a vibrating unit (not illustrated) connected to the controller 160. The mode for receiving a user's input beat is achieved by receiving a movement of the mobile device 100 detected by the sensor 110, a touch detected by the touch screen 120, or a user's voice via the microphone. It should be understood that the mode for a user's input beat is not limited thereto. However, the user's input beat can be received by any other means that can receive a user's beat. The beat matching frequency may be a certain number of matching beats compared with each other during a preset period of time or a frequency of continuously performing a certain beat. The beat matching count is a variable to count the frequency of matching a preset beat with a user's input beat.

The audio processing unit 150 outputs audio signals from an audio COder-DECoder (CODEC) to a Speaker (SPK) and transfers audio signals, input via a Microphone (MIC), to the audio CODEC.

The controller 160 controls operations of the mobile device 100. The controller 160 includes a timer 162. The timer 162 creates time data under the control of the controller 160. Created time data is used when the controller performs a counting operation.

The controller 160 creates alarm execution and termination setting information in an alarm setting mode and stores it in the storage unit 140. The controller 160 reproduces or mutes an alarm audio sound or terminates an alarm, according to the alarm execution and termination setting information, in an alarm execution mode. To this end, the controller 160 determines whether a preset beat matches with a user's input beat, detects the frequency of the matching beats, and determines whether an alarm operation exceeds an alarm execution time.

Figure 2:
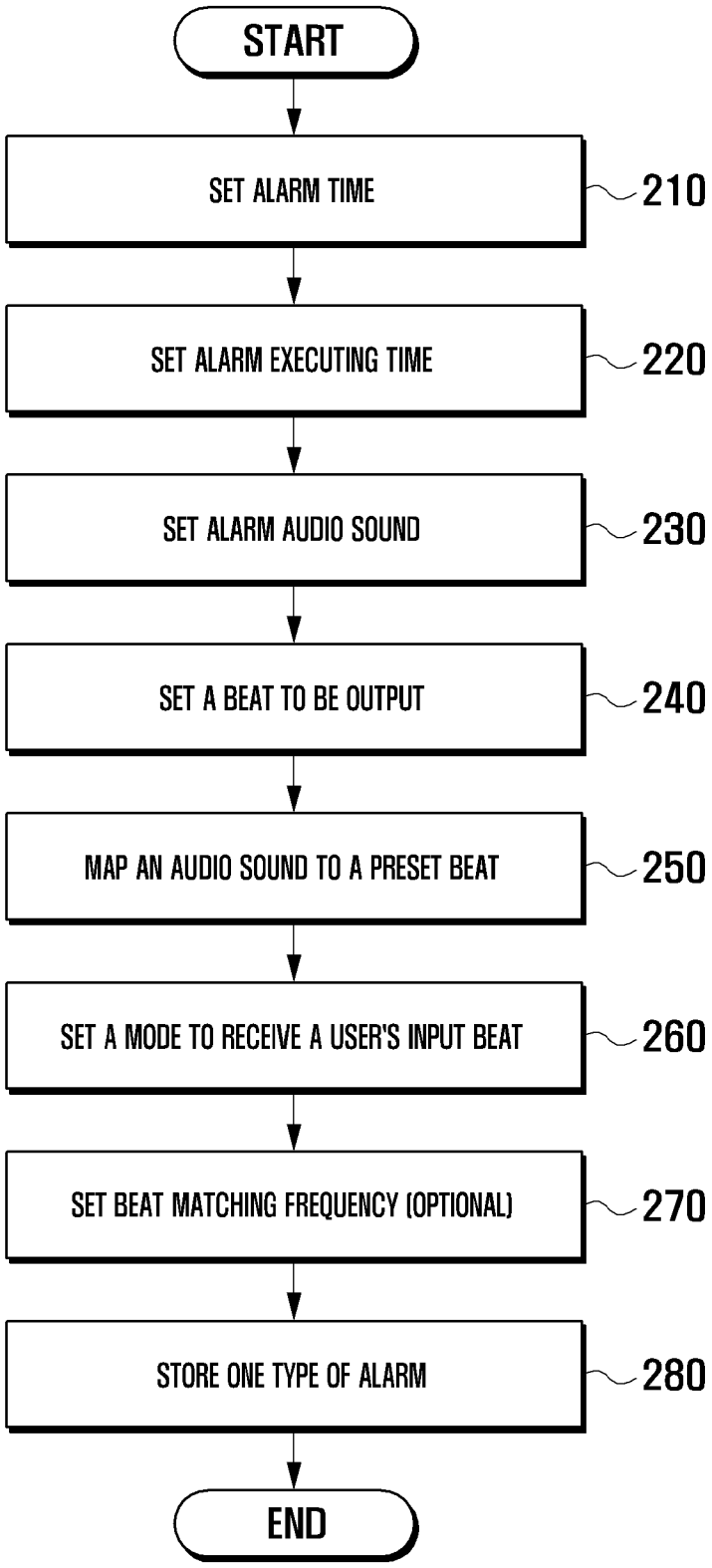
FIG. 2 is a flowchart illustrating a method for setting information to execute an alarm and turning off the alarm, according to an exemplary embodiment of the present invention.

FIG. 2 is a flowchart illustrating a method for setting information to execute an alarm and turning off an alarm, according to an exemplary embodiment of the present invention.

Although the method is described based on a particular sequence, it should be understood that the sequence of the description does not limit the sequence of execution. It is assumed herein that the user inputs setting information via the touch screen 120 or the key input unit 130.

Referring to FIG. 2, the controller 160 sets information regarding the alarm execution and termination in an alarm setting mode. The controller 160 stores an alarm time, input via the key input unit 130 or the touch screen 120, in the storage unit 140 at step 210. The controller 160 stores an alarm execution time in the storage unit 140 at step 220. The controller 160 sets an alarm audio sound to be reproduced in an alarm execution mode at step 230. The alarm audio sound may be newly input or selected from a list of candidate alarm audio sounds stored in the storage unit 140. The newly set alarm audio sound is stored in the storage unit 140.

After setting an alarm audio sound at step 230, the controller 160 sets a beat to be output according to the set alarm audio sound, i.e., a preset beat, at step 240. Simultaneously, the controller 160 also sets a mode for outputting the preset beat. The controller 160 sets a beat to be output according to the set alarm audio sound, via a beat extracting unit (not illustrated). Alternatively, the controller 160 may also set a beat to be output according to the set alarm audio sound, so that the beat can include a preset regular time interval. The controller 160 may further include a beat extracting unit (not illustrated) that extracts a preset beat from an audio sound. For example, the beat extracting unit transforms signals of a preset alarm audio sound into a frequency domain and then classifies them by frequency bands. Thereafter, the beat extracting unit extracts beats from the classified frequency bands, with respect to a particular intensity. That is, the beat extracting unit sets a beat, by designating a period for a frequency band with intensity equal to or greater than a particular value as a period for a beat. Alternatively, the controller 160 may set a beat to have a certain period, e.g., a regular time interval of 3 seconds. A beat with a time interval of 3 seconds may be output to a display unit (not illustrated) or a vibrating unit (not illustrated), per 3 seconds, in the alarm execution mode. The controller 160 stores the information regarding such a preset beat and the beat outputting mode in the storage unit 140.

Thereafter, the controller 160 maps the set alarm audio sound to the preset beat, with respect to time at step 250. That is, the controller 160 maps the set alarm audio sound to the preset beat, so that a time point for reproducing an alarm audio sound is identical to that of outputting a beat. The controller 160 sets a mode for receiving a user's input beat at step 260. Examples of the movement of the mobile device 100 may be a movement at a particular speed regardless of the direction of the mobile device 100, a movement according to a particular trajectory of the mobile device 100, or a reciprocal movement. The controller 160 sets a beat matching frequency at step 270. Thereafter, the controller 160 stores the information regarding the set alarm execution and termination for one type of alarm at step 280.

Figure 3:
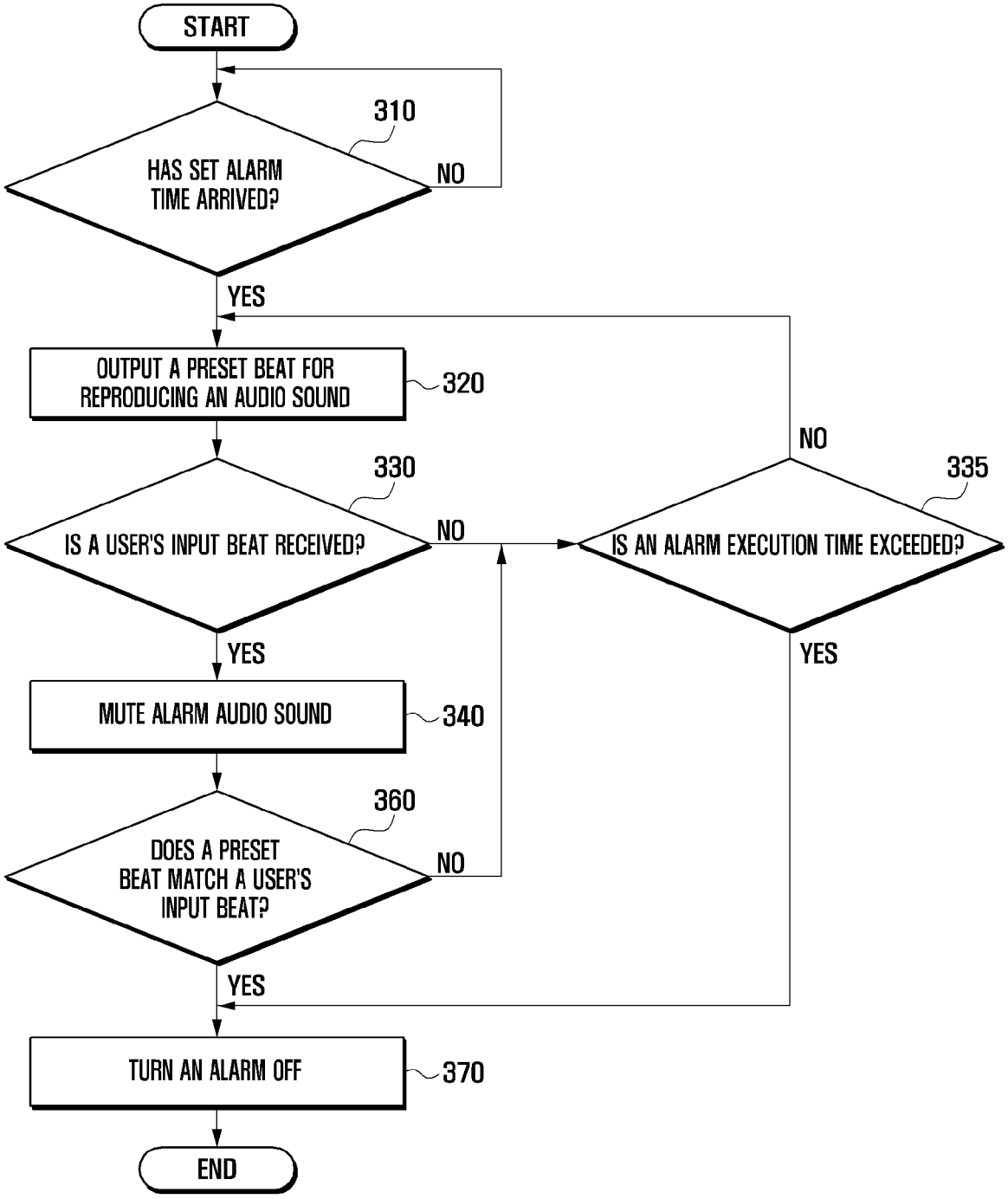
FIG. 3 is a flowchart illustrating a method for turning off an alarm according to an exemplary embodiment of the present invention.

FIG. 3 is a flowchart illustrating a method for turning off an alarm according to an exemplary embodiment of the invention.

Referring to FIG. 3, the controller 160 determines whether a set alarm time arrives at step 310. That is, the controller 160 verifies the set alarm time stored in the storage unit 140. The controller 160 determines whether a set alarm time arrives via the timer 162. If the controller 160 determines that a set alarm time does not arrive at step 310, it maintains the current state of the mobile device 100. On the contrary, if the controller 160 determines that a set alarm time arrives at step 310, it executes an alarm execution mode. In the alarm execution mode, the controller 160 may reproduce or mute an audio sound, may output a beat, and may receive a user's input beat.

The controller 160 reproduces an alarm audio sound stored in the storage unit 140 and outputs a preset beat at step 320.

When the controller 160 reproduces the alarm audio sound at step 320, it may further determine whether the mobile device 100 is set in a ring mode or a vibration mode. If it is determined that the mobile device 100 is set in a ring mode, the controller 160 controls the audio processing unit 150 to output an audio sound. On the other hand, if it is determined that the mobile device 100 is set in a vibration mode, the controller 160 outputs the vibration at a certain period via the vibrating unit (not illustrated). It should be understood that exemplary embodiments of the present invention are not limited to the modes for outputting an audio sound via the audio processing unit 150 and outputting vibration via the vibrating unit, rather the present invention may be implemented with any other modes that allows the user to recognize an audio sound.

When the controller 160 outputs a preset beat at step 320, it may use a display unit (not illustrated) of the touch screen 120 or a vibrating unit (not illustrated) according to the setting of a mode for outputting the preset beat. When the mode is set to output the preset beat via the display unit, the preset beat is displayed as a series of symbols flowing in a certain direction and the beat outputting time point is effectively expressed in such a way to flash one of the series of symbols. It should be noted that the mode for outputting a beat may be variously altered or modified. On the other hand, when the mode is set to output the preset beat via the vibrating unit, the controller 160 controls the vibrating unit to vibrate at the period for the preset beat. It should also be understood that exemplary embodiments of the present invention is not limited to the modes for outputting a preset beat via the display unit or the vibrating unit, rather exemplary embodiments of the present invention may be implemented with any other mode that allows the user to recognize the preset beat.

Alternatively, the controller 160 turns on a means for detecting a user's input beat, i.e., the sensor 110, the touch screen 120 or the MIC, according to the settings of the mode for receiving a user's input beat, at step 320. In addition, the controller 160 initializes a value of a beat matching count.

Thereafter, the controller 160 determines whether the mobile device 100 receives a user's input beat, using a signal output from the means for detecting a user's input beat at step 330. The controller 160 can determine whether the mobile device 100 receives a user's input beat when the preset beat is output. If the controller 160 determines that the mobile device 100 does not receive a user's input beat at step 330, it determines whether a set alarm execution time elapses via the timer 162 at step 335. If the controller 160 determines that a set alarm execution time has not elapsed at step 335, it returns to step 320. That is, when the mobile device 100 does not receive a user's input beat at step 330, the controller 160 performs a control operation to keep reproducing an alarm audio sound. On the contrary, if the controller 160 determines that a set alarm execution time has elapsed at step 335, it turns off the alarm at step 370, which will be described in more detail below.

Meanwhile, if the controller 160 determines that the mobile device 100 receives a user's input beat at step 330, it mutes an alarm audio sound at step 340. In an exemplary implementation, 'to mute an alarm audio sound' denotes that an alarm audio sound, output via the audio processing unit 150, is muted or vibration corresponding to an alarm audio sound output from the vibrating unit is interrupted. The controller 160 mutes the alarm audio sound but performs a control operation to continue outputting the preset beat. Therefore, the controller 160 can guide the user to input a beat according to the preset beat, output in a state where the alarm audio sound is muted.

While the alarm audio sound is muted, the controller 160 determines whether the user's input beat matches the preset beat at step 360. When a time point that the preset beat is output matches a time point that the user's input beat is received or the difference between the two time points is within a range of error, the controller 160 concludes that the preset beat matches the user's input beat. Each time that the controller 160 concludes that the two beats match with each other, the controller 160 increases the beat matching count by one.

If the controller 160 determines that the number of occurrences where two beats match with each other is a preset number at step 360, it turns off the alarm at step 370. For example, when a beat is output, at an interval of 3 seconds, for 20 seconds, a beat matching frequency can be set to four times. In this case, the controller 160 determines whether a set alarm execution time has elapsed via the timer 162, and then controls a beat matching counter to count how many times the preset beat matches the user's input beat. When the controller 160 determines that the preset beat matches with the user's input beat at least four times for 20 seconds, it turns off the alarm at step 370. On the contrary, when the controller 160 determines that the preset beat matches with the user's input beat less than the preset number, it returns to step 335. When the controller 160 concludes that an alarm execution time has not elapsed at step 335, it returns to step 320. That is, when the preset beat matches with the user's input beat less than a certain number in a state where an alarm audio sound is muted, the controller 160 reproduces the muted audio sound within a certain range of time to not exceed the alarm execution time. In addition, the controller 160 initializes the beat matching count. For example, when the beat matching frequency is set to four times the number that the preset beat continuously matches with the user's input beat, the controller 160 counts the continuously matching beat frequency via the beat matching counter. Thereafter, the controller 160 determines whether an alarm service is turned off, based on the continuously matching beat frequency.

The controller 160 turns off the alarm at step 370. When an audio sound is being reproduced, the controller 160 terminates reproducing the audio sound, stops outputting the beat, and turns off a means for detecting the user's input beat. In an exemplary implementation, when an alarm execution time elapses during the alarm execution mode, the controller 160 can immediately terminate the alarm. In another exemplary implementation, the controller can also enforcedly terminate the alarm execution mode, when a key mapped to an alarm termination function is input to the key input unit 130.

As described above, the alarm turning off method and the mobile device adapted thereto, according to exemplary embodiments of the present invention, are designed to learn and store a beat mapping to an audio sound and turnoff an alarm when the user gestures a certain pattern. The alarm turning off method and the mobile device adapted thereto make the user aware of conscious and continuous movements, so that he/she can easily wake up.

Alternatively, the alarm tuning off method and the mobile device adapted thereto, according to exemplary embodiments of the present invention, can turn off the alarm when the user inputs, to the mobile device, a beat matching a beat set in a state where an alarm audio sound is muted, via a preset mode. This makes the user induce a conscious motion towards the mobile device, so that the user can easily and rapidly wake up. Since the mobile device, in a state where an audio sound is muted, receives a user's input for turning off an alarm, it does not inconvenience other people near the user. Therefore, the alarm turning off method and the mobile device adapted thereto can maximize the efficiency of the alarm service.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A method for turning off an alarm in a mobile device, the method comprising:

reproducing a preset alarm audio sound and outputting a preset beat at a preset alarm time;

determining whether the mobile device receives an input beat;

muting, when the mobile device has received the input beat, the reproduced alarm audio sound;

determining whether the preset beat is identical to the input beat in a state where the alarm audio sound is muted; and turning off the alarm when the number of occurrences where the preset beat matches the input beat is greater than or equal to a preset number in a state where the alarm audio sound is muted.

2. The method of claim 1, further comprising:

reproducing the muted alarm, when the number of occurrences where the preset beat matches the input beat is less than a preset number.

3. The method of claim 1, wherein the preset beat is at least one of extracted from the preset alarm audio sound and has a preset regular time interval.

4. The method of claim 1, wherein the input beat is at least one of a motion, a touch, and a signal, detected by the mobile device.

5. The method of claim 1, wherein the preset beat is output via a display unit or a vibrating unit.

6. The method of claim 5, wherein, if the preset beat is output via the display unit, the preset beat is at least one of displayed via a series of symbols flowing in a certain direction and output time point of the preset beat is expressed by one of the series of symbols being flashed; and wherein, if the preset beat is output via the vibrating unit, the vibrating unit vibrates at a certain period.

7. A mobile device comprising:

an audio processing unit configured to reproduce a preset alarm audio sound;

a display unit configured to display a preset beat;

a storage unit configured to store the preset alarm audio sound and the preset beat; and a controller configured to control to reproduce the preset alarm audio sound at a preset alarm time, configured to mute, when the mobile device has received a input beat, the reproduced alarm audio sound, and configured to stop an output of the preset beat when the number of occurrences where the preset beat matches the input beat is greater than or equal to a preset number.

8. The mobile device of claim 6, wherein the controller controls to reproduce the muted alarm and determines whether the mobile device receives the input beat, when the number of occurrences where the preset beat matches the input beat is less than a preset number.

9. The mobile device of claim 7, wherein the controller at least one of extracts the preset beat from the preset alarm audio sound and performs a control operation so that the preset beat has a preset regular time interval.

10. The mobile device of claim 7, further comprising:

at least one of a sensor configured to detect the input beat, a microphone, and a touch screen.

11. The mobile device of claim 7, further comprising:

wherein the controller controls output of the preset beat via one of the display unit and a vibrating unit.

12. The mobile device of claim 11, wherein the controller controls the display unit to output the preset beat as a series of symbols flowing in a certain direction and express output time point of the preset beat by one of the series of symbol.

13. The mobile device of claim 11, wherein the controller controls the vibrating unit to vibrate at a certain period for the preset beat.

14. A method for turning off an alarm in a mobile device, the method comprising:

reproducing a preset alarm audio sound and outputting a preset beat at a preset alarm time;

determining whether the mobile device receives an input beat;

when the mobile device has received the input beat, determining whether the preset beat is identical to the input beat; and turning off the alarm when the number of occurrences where the preset beat matches the input beat is greater than or equal to a preset number.

15. The method of claim 14, wherein the outputting of the preset beat at the preset alarm time comprises reproducing a time point of an alarm audio sound identical to that of the outputting the preset beat.

16. A mobile device comprising:

an audio processing unit configured to reproduce a preset alarm audio sound;

a display unit configured to display an alarm;

a storage unit configured to store the preset alarm audio sound and the preset beat; and a controller configured to reproduce the preset alarm audio sound at a preset alarm time, and stop outputting of the preset beat when the mobile device has received a input beat, and the number of occurrences where the preset beat matches the input beat is greater than or equal to a preset number.

17. The mobile device of claim 16, wherein the controller reproduces a time point of an alarm audio sound identical to that of the outputting of the preset beat.

* * * * *